US009857110B2

(12) United States Patent
Khoo

(10) Patent No.: US 9,857,110 B2
(45) Date of Patent: Jan. 2, 2018

(54) APPARATUS FOR IMPROVING THE EFFICIENCY OF A HEAT EXCHANGE SYSTEM

(71) Applicant: Articmaster Inc., Las Vegas, NV (US)

(72) Inventor: Cass Khoo, Alameda, CA (US)

( * ) Notice: Subject to any disclaimer, the term of this patent is extended or adjusted under 35 U.S.C. 154(b) by 35 days.

(21) Appl. No.: 14/660,841

(22) Filed: Mar. 17, 2015

(65) Prior Publication Data

US 2016/0178242 A1 Jun. 23, 2016

Related U.S. Application Data

(60) Provisional application No. 62/095,500, filed on Dec. 22, 2014.

(51) Int. Cl.
*F25B 43/00* (2006.01)
*F25B 41/00* (2006.01)
*F25B 40/02* (2006.01)

(52) U.S. Cl.
CPC ..... *F25B 41/003* (2013.01); *F25B 40/02* (2013.01); *F25B 2400/16* (2013.01); *F25B 2500/01* (2013.01)

(58) Field of Classification Search
CPC ..... F25B 41/003; F25B 40/00; F25B 40/02; F25B 2400/16
See application file for complete search history.

(56) References Cited

U.S. PATENT DOCUMENTS 5,570,589 A * 11/1996 Petty ..... F25B 43/006 62/471
5,829,262 A * 11/1998 Urata ..... F25B 9/006 62/174
2003/0140652 A1* 7/2003 Yamazaki ..... B60H 1/3229 62/509
2005/0229632 A1* 10/2005 Obrist ..... F25B 9/008 62/512

* cited by examiner

*Primary Examiner* — Elizabeth Martin
(74) *Attorney, Agent, or Firm* — Sumana Prabhu

(57) ABSTRACT

A method and apparatus for use with a heat exchange system having a compressor, condenser, evaporator, an expansion device, and circulating refrigerant is provided. The apparatus comprises a chamber positioned between the condenser and the evaporator. According to an embodiment of the invention, the chamber comprises a down tube with holes for the passage of refrigerant from the chamber and a top inlet port comprising a vapor expansion screen. The suction of the refrigerant through the holes draws refrigerant towards the top inlet port past the vapor expansion screen, allowing for further cooling within the chamber. When the refrigerant eventually exits the chamber, it is considerably cooler than when it entered the vessel, making the entire refrigeration system more efficient.

18 Claims, 2 Drawing Sheets

APPARATUS FOR IMPROVING THE EFFICIENCY OF A HEAT EXCHANGE SYSTEM

CROSS-REFERENCE TO RELATED APPLICATION

This patent application claims the priority benefit under 35 U.S.C. §119(e) of U.S. Provisional Application No. 62/095,500 filed on Dec. 22, 2014, the contents of which are herein incorporated by reference.

FIELD OF THE INVENTION

The present invention relates generally to heat exchange systems and particularly to refrigeration and air conditioning devices. More specifically, an inventive apparatus is disclosed that achieves maximum refrigerant operational conditions while reducing energy consumption by the system.

BACKGROUND OF THE INVENTION

Various devices relying on standard refrigerant recycling technologies have been available for many years, such as refrigeration and heat pump devices, having both cooling and heating capabilities. Within the limits of each associated design specification, heat pump devices enable a user to cool or heat a selected environment or with a refrigeration unit to cool a desired location. For these heating and cooling duties, in general, gases or liquids are compressed, expanded, heated, or cooled within an essentially closed system to produce a desired temperature result in the selected environment.

The four basic components used in a refrigeration system are: a compressor; a condenser (heat exchanger); an evaporator (heat exchanger) and an expansion valve. These components are the same regardless of the size of the system. Gaseous refrigerant is compressed by the compressor and transported to the condenser which causes the gaseous refrigerant to liquefy. The liquid refrigerant is transported to the expansion valve and permitted to expand gradually into the evaporator. After evaporating into its gaseous form, the gaseous refrigerant is moved to the compressor to repeat the cycle.

For a refrigerant system to function efficiently, it is very essential that the refrigerant reaching the expansion valve be completely liquified. However, in most cases the vapor from the expansion valve entering the evaporator is not totally vaporized and exists in a both liquid and vapor phase as well. The liquid in the evaporator is in an adiabatic state and therefore cannot absorb or reject heat. Only when liquid changes to the vapor state absorption is increased. The problem is especially true in colder conditions where the refrigerant is not totally vaporized by the time it comes out of the evaporator and a small amount of liquid could go into the compressor. Since liquid cannot be compressed the compressor gets loaded and is ultimately damaged.

The present invention seeks to overcome this problem. A new and improved method of increasing the efficiency and economy of a refrigeration system is presented.

BRIEF SUMMARY OF THE INVENTION

According to an embodiment of the invention, an apparatus (herein referred to as auxiliary passive condenser) is provided comprising a chamber having a refrigerant entry port for receiving condensed liquid refrigerant from the condenser and an exit port for passage of exiting liquid refrigerant. The chamber is formed from a cylinder capped by a top end cap and a bottom end cap and is positioned in the heat exchange system between the condenser and the evaporator. A refrigerant entrance is located in a top region of the chamber and a refrigerant exit is located in a bottom region of the chamber. Preferably, the refrigerant exit is positioned to be no lower than approximately a lowest point in the condenser.

The passive condenser further comprises a down tube for sub cooling liquid refrigerant entering the chamber wherein the down tube passes through the center of said chamber and through the exit port. The down tube comprises at least three holes located near the bottom of the tube.

In a preferred embodiment, the down tube comprises a top inlet port for the passage of non-condensed vapor wherein the top inlet port comprises an expansion screen.

Other novel features which are characteristic of the invention, as to organization and method of operation, together with further objects and advantages thereof will be better understood from the following description considered in connection with the accompanying drawings. It is to be expressly understood, however, that the drawings are for illustration and description only and are not intended as a definition of the limits of the invention.

The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention.

It is important, therefore, that the claims be regarded as including such equivalent constructions insofar as they do not depart from the spirit and scope of the present invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
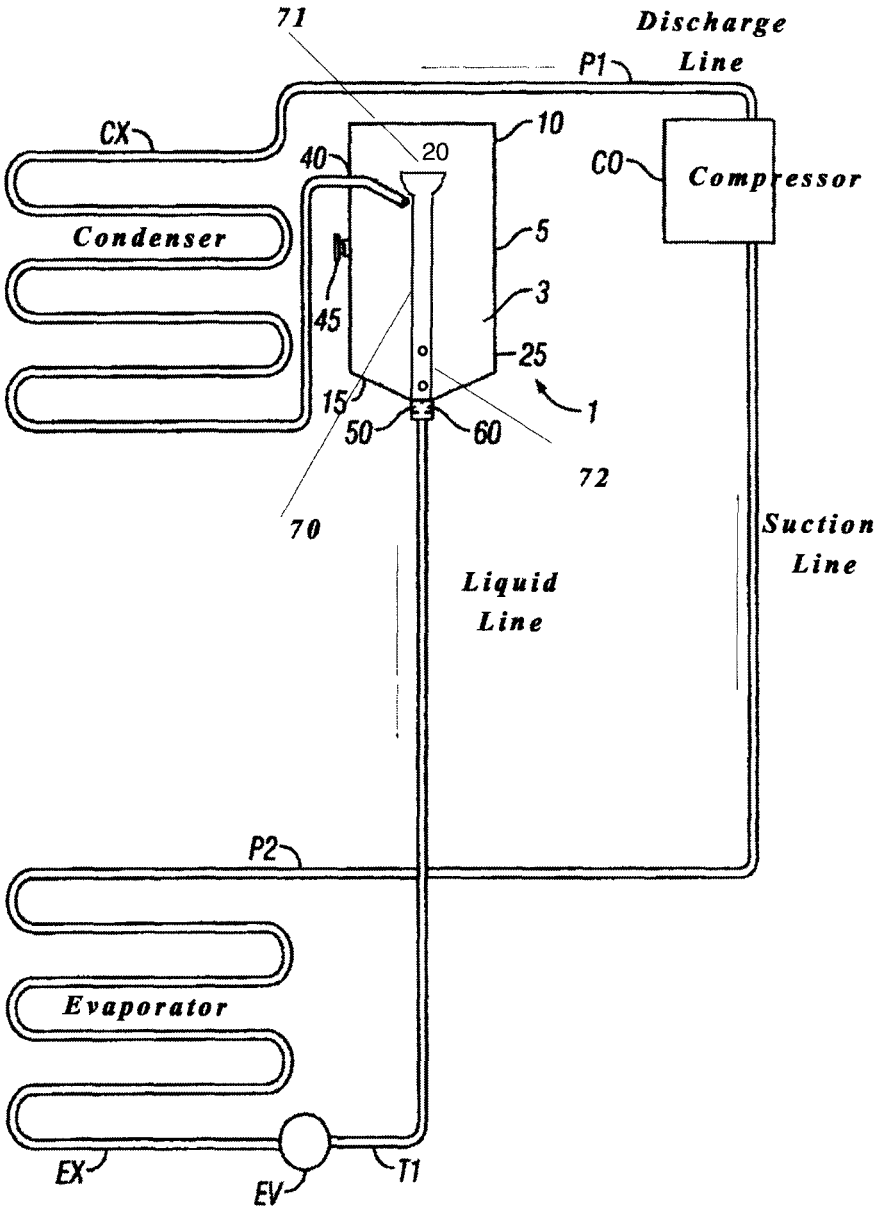
FIG. 1 is a refrigeration system which shows the auxiliary passive condenser of present invention positioned between the condenser and the evaporator.

By way of introduction to the environment in which the inventive system operates, the following is a brief description of the functioning of a traditional refrigeration system.

An expandable-compressible refrigerant is contained and cycled within an essentially enclosed system comprised of various refrigerant manipulating components. The four basic components used in a refrigeration system (or in general a heat pump) are: a compressor; a condenser (heat exchanger); an evaporator (heat exchanger); an expansion valve; and the necessary plumbing to connect the components. These components are the same regardless of the size of the system. Gaseous refrigerant is compressed by the compressor and transported to the condenser which causes the gaseous refrigerant to liquefy. The liquid refrigerant is transported to the expansion valve and permitted to expand gradually into the evaporator. After evaporating into its gaseous form, the gaseous refrigerant is moved to the compressor to repeat the cycle.

As indicated, even though the subject invention is used preferably with a refrigeration system, adaptation to a generalized heat pump system is also contemplated. Therefore, for a heat pump, heating or cooling conditions are generated in the first and second environments by reversing the process within the enclosed system.

During compression the refrigerant gas pressure increases and the refrigerant gas temperature increases. When the gas temperature/pressure of the compressor is greater than that of the condenser, gas will move from the compressor to the condenser. The amount of compression necessary to move the refrigerant gas through the compressor is called the compression ratio. A lower compression ratio reflects a higher system efficiency and consumes less energy during operation. The higher the gas temperature/pressure on the condenser side of the compressor, the greater the compression ratio. The greater the compression ratio the higher the energy consumption. Further, the energy (KW) necessary to operate a cooling or heat exchange system is primarily determined by three factors: the compressor's compression ratio; the refrigerant's condensing temperature; and the refrigerant's flow characteristics.

The compression ratio is determined by dividing the discharge pressure (head) by the suction pressure. Any change in either suction or discharge pressure will change the compression ratio.

It is noted that for refrigeration systems or any heat pump systems when pressure calculations are performed they are often made employing absolute pressure units (PSIA), however, since most individuals skilled in the art of heat pump technologies are more familiar with gauge pressure (PSIG), gauge pressures are used as the primary pressure units in the following exemplary calculations. In a traditional refrigeration system, a typical discharge pressure is 226 PSIG (241 PSIA) and a typical suction pressure is 68 PSIG (83 PSIA). Dividing 226 PSIG by 68 PSIG yields a compression ratio of about 2.9.

The condensing temperature is the temperature at which the refrigerant gas will condense to a liquid, at a given pressure. Well known standard tables relate this data. In a traditional example, using R22 refrigerant, that pressure is 226 PSIG. This produces a condensing temperature of 110 degrees F. At 110 degrees F., each pound of liquid freon that passes into the evaporator will absorb 70.052 Btu's. However, at 90 degrees F. each pound of freon will absorb 75.461 Btu.'s. Thus, the lower the temperature of the liquid refrigerant entering the evaporator the greater its ability to absorb heat. Each degree that the liquid refrigerant is lowered increases the capacity of the system by about one-half percent.

Well known standard tables of data that relate the temperature of a liquid refrigerant to the power required to move Btu's per hour show that if the liquid refrigerant is at 120 degrees F., 0.98 hp will move 22873 Btu's per hour. If the liquid refrigerant is cooled to 60 degrees F., only 0.2 hp is required to move 29563 Btu's per hour.

Referring now to FIG. 1, there is shown a schematic view of a refrigeration system adapted with the invention. Components of system include compressor CO; condenser CX; evaporator EX; and expansion valve EV, with the auxilia passive condenser 1 positioned between the condenser CX and the evaporator EX.

Figure 2:
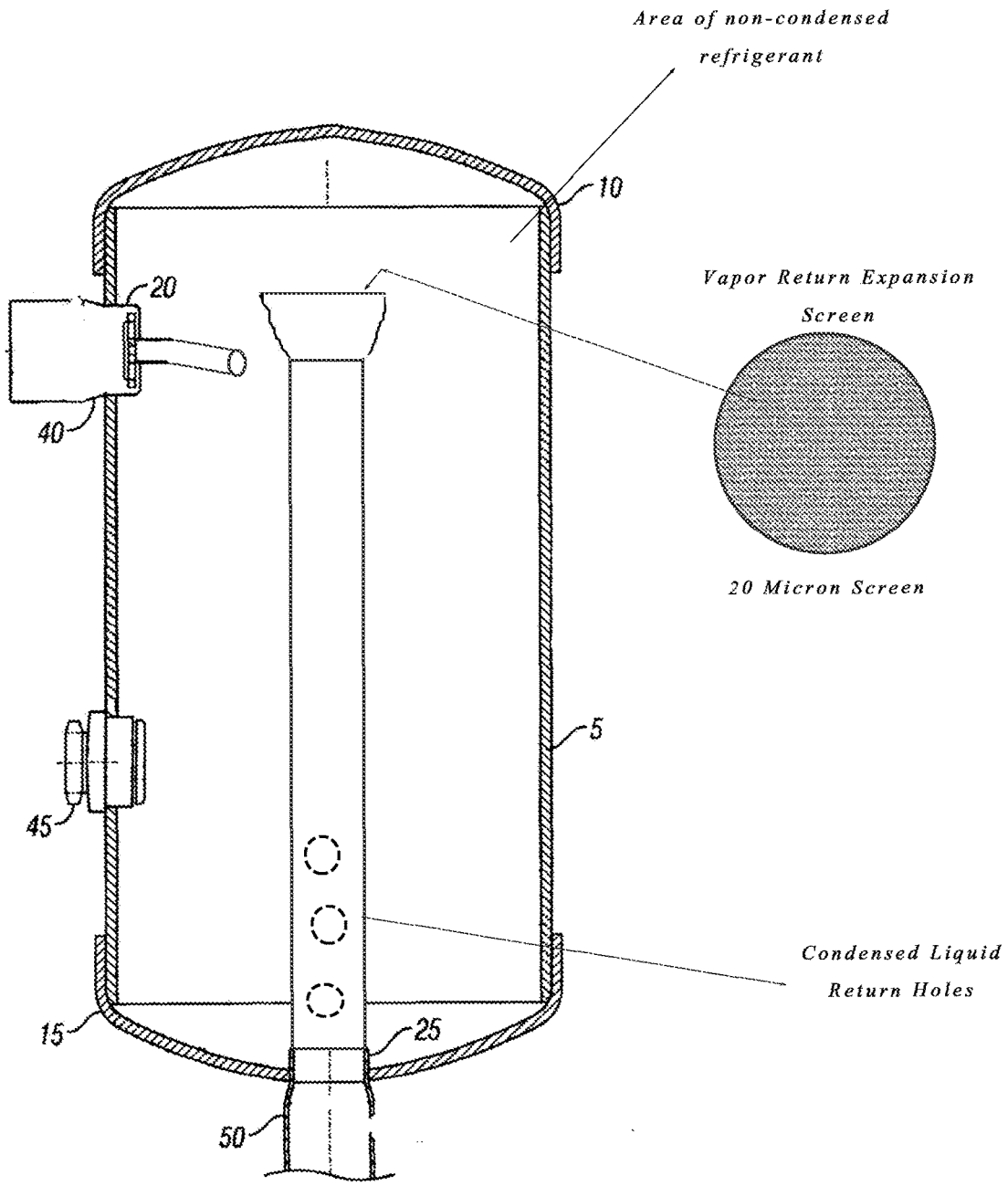
FIG. 2 shows a cross-sectional view of the auxiliary passive condenser.

FIG. 2 is a cross-sectional view of the inventive auxiliary passive condenser for the system, used to condense and thereby sub-cool a portion of the refrigerant within the chamber 1. The auxiliary passive condenser is preferably fabricated from a cylinder 5 and top 10 and bottom 15 end caps of suitable material such a metal, metal alloy, or natural or synthetic polymers. Generally, the top 10 and bottom 15 end caps are secured to the cylinder 5 by appropriate means such as soldering, welding, brazing, gluing, threading and the like, however, the entire chamber may be formed from a single unit with the cylinder 5 and top 10 and bottom 15 end caps as a unitized construction.

A liquid refrigerant entrance 20 and a liquid refrigerant exit 25 penetrate the passive condenser. Preferably, the refrigerant entrance 20 is located in a top region of the chamber 1. The top region is defined as being approximately between a midline of the cylinder 5, bisecting the cylinder 5 into two smaller cylinders, and the top end cap 10. Preferably, the refrigerant exit 25 is located in a bottom region of the chamber 1. The bottom region of the chamber 1 is defined as being approximately between the midline, above, and the bottom end cap 15. Although other locations are possible, the refrigerant exit 25 is preferably located proximate the center of the bottom end cap 15.

Usually, the bottom end cap 15 has an angled or sloping interior surface 30. However, the bottom end cap 15 may have an interior surface of other suitable configurations, including being flat.

Liquid refrigerant liquefied by the condenser CX enters into the chamber via the refrigerant entrance 20 and the associated components. The associated entrance components comprise an entrance fitting 40 that secures the chamber 1 into the exit portion of the plumbing coming from the condenser CX. The entrance fitting 40 is any suitable means that couples the subject device into the plumbing in the required position between the condenser CX and the evaporator EX.

To view the level of the liquid refrigerant within the chamber 1, a sight glass 45 is provided. The glass 45 is mounted in the cylinder 5 at a position to note the refrigerant level.

In the center of the passive condenser is a down tube 70 with an inlet 71 at the top surface and an outlet at the bottom that passes through the exit fitting, 50. Preferably, the inlet 71 has a width that is greater than the rest of the tube so that the tube is almost shaped like a funnel. The inlet is further sealed with a vapor tube expansion screen such as a mesh/sieve. Preferably, the mesh size varies between 10 microns to 50 microns and could be made from copper, aluminum or any alloy containing copper. However, depending on the thickness of the down tube, the mesh size can vary beyond this range. Liquid refrigerant from the condenser CX enters the auxiliary passive condenser and flows to the bottom of the unit, filling up to almost one-third of the volume of the unit. At least three holes 72, are located in the lower portion of the down tube. Preferably the holes are positioned in the lower region about one fourth the height of the cylinder. The condensed liquid refrigerant that flows into the passive condenser, passes through the holes and into the down tube. The size of the holes are designed so that almost half the length of the down tube is filled with the refrigerant liquid before draining at the bottom 60, thereby creating a vortex to the exit, and around the down tube.

The suction of the refrigerant through the holes 72 at the bottom of the down tube creates a vacuum inside the tube. As a result, the non-condensed refrigerant is drawn towards the top inlet of the down tube 71 past the vapor tube expansion screen, raising the non-condensed refrigerant up further and allowing for further cooling within the chamber. When the refrigerant eventually exits the passive condenser, it is considerable cooler than when it entered the vessel, making the entire refrigeration system more efficient. This cooling state can be greatly improved with a vortex flow as well as increasing the inlet and outlet line size, to coincide with the size of the refrigeration unit.

Preferably, the auxiliary passive condenser is placed in he adapted system. so that the refrigerant exit 25 is no lower than the lowest portion of the condenser CX. The refrigerant exit 25 is comprised of an exit tube and fitting 50 that secures the subject device into the plumbing of the system. The exit fitting 50 is any suitable means that couples the subject device into the plumbing in the required position between the condenser CX and the evaporator EX.

In one embodiment, in order to get more suction, the return line which is the down tube may be enlarged. The refrigerant flow may also be enhanced by increasing the ratio of size of the inlet to the size of the outlet pipe. This gives more low pressure as needed for adequate cooling of the refrigerant within the secondary condenser or supplementary (auxiliary) passive condenser.

With the development of the low pressure area, the small amount of refrigerant entering the holes at the lower end of the down tube create a vacuum and allow the heat bubbles carried by the refrigerant to continue to condense so as to allow the refrigerant that is delivered downstream to the expansion valve to have less non-condensed refrigerant within it, thereby improving the operation of the system.

In another preferred embodiment, the system also includes an atomizer incorporated into the refrigerant path downstream of the expansion valve and before the coil. The atomizer preferably includes an incremental expansion device disk which develops a low pressure area on the back side. The refrigerant is then focused in a spiral manner by a set of fixed planes. This develops a vortex that continues through the refrigerant coil, ensuring uniform flow through the coil to increase coil efficiency and reduce refrigerant pooling. A heat exchanger is used to remove any heat the expansion device captures.

With the addition of a condenser controller with adiabatic sub-cooling, it is possible to tune a refrigeration system using an adjustable thermostat expansion valve (EV). Just as the thermostat expansion valve adjusts to varying conditions at the evaporator, this condenser control allows the condenser to be adjusted under varying conditions as well.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like, Therefore, the above description and illustrations should not be construed as limiting the scope of the invention, which is defined by the appended claims.

I claim:

1. An apparatus for enhancing the efficiency of a heat exchange system having a compressor, condenser, expansion valve, evaporator and a circulating refrigerant, said apparatus positioned between the condenser and the evaporator of said system and comprising the following:

a chamber having a refrigerant entry port in the top region and a refrigerant exit port in the bottom region;

a down tube passing through the center of said chamber and through the refrigerant exit port; said down tube comprising holes to permit the passage of refrigerant from the chamber into said down tube; wherein said holes are located in the lower portion of the down tube; and a vapor condensing means associated with said down tube for condensing uncondensed gas refrigerant into the down tube.

2. The apparatus of claim 1, wherein said down tube comprises at least three holes.

3. The apparatus of claim 2, wherein said down tube further comprises a top inlet port and a bottom outlet port.

4. The apparatus of claim 3 wherein the ratio of the diameter of said inlet port to said outlet port is greater than 1.

5. The apparatus of claim 4, wherein said vapor condensing means comprises an expansion screen located at the top inlet port.

6. The apparatus of claim 5, wherein said screen is a mesh comprising copper, aluminum or a copper-based alloy.

7. A method of enhancing the efficiency of a heat exchange system having a compressor, condenser, evaporator, and a circulating refrigerant, said method comprising the steps of:

providing an apparatus between the condenser and the evaporator; wherein said apparatus comprises a chamber with a refrigerant entry port in the top region and a refrigerant exit port in the bottom region;

providing a down tube that passes through the center of said chamber for providing holes in the lower portion of said down tube to permit the passage of refrigerant from the chamber into the down tube; and further providing a vapor condensing means on the down tube for condensing uncondensed gas refrigerant into the down tube.

8. The method of claim 7, wherein said down tube comprises at least three holes.

9. The method of claim 8, wherein said down tube further comprises a top inlet port and bottom outlet port.

10. The method of claim 9, wherein the ratio of the diameter of said inlet port to said outlet port is greater than 1.

11. The method of claim 10, wherein said vapor condensing means comprises an expansion screen located at the top inlet port.

12. The method of claim 11, wherein said expansion screen is a mesh comprising copper, aluminum or a copper-based alloy.

13. A heat exchange system comprising: a compressor, a condenser, an evaporator, an expansion valve, a circulating refrigerant, and an efficiency enhancing apparatus positioned between the condenser and the evaporator; said apparatus comprising:

a chamber comprising a refrigerant entry port in the top region and a refrigerant exit port in the bottom region; and a down tube passing through the center of said chamber and through the exit port; said down tube comprising holes to permit the passage of refrigerant from the chamber into said down tube; wherein said holes are located in the lower portion of the down tube; and a vapor condensing means associated with said down tube for condensing uncondensed vapor into the down tube.

14. The heat exchange system of claim 13 wherein said down tube comprises at least three holes.

15. The heat exchange system of claim 14, wherein said down tube comprises a top inlet port and a bottom outlet port.

16. The heat exchanger of claim 15 wherein the ratio of the diameter of said inlet port to said outlet port is greater than 1.

17. The heat exchange system of claim 16, wherein said vapor condensing means comprises an expansion screen located at the top inlet port.

18. The heat exchange system of claim 17, wherein said expansion screen is a mesh comprising copper, aluminum or a copper-based alloy.

* * * * *